US009908359B2

(12) United States Patent
DeLise, Jr.

(10) Patent No.: US 9,908,359 B2
(45) Date of Patent: Mar. 6, 2018

(54) EXTENDED CONTENT BOOKLET LABELS

(71) Applicant: MINIGRAPHICS, INC., Hauppauge, NY (US)

(72) Inventor: Stephen W. DeLise, Jr., West Islip, NY (US)

(73) Assignee: MINIGRAPHICS, INC., Hauppauge, NY (US)

( * ) Notice: Subject to any disclaimer, the term of this patent is extended or adjusted under 35 U.S.C. 154(b) by 158 days.

(21) Appl. No.: 13/969,545

(22) Filed: Aug. 17, 2013

(65) Prior Publication Data

US 2013/0334805 A1 Dec. 19, 2013

Related U.S. Application Data

(63) Continuation-in-part of application No. 13/483,355, filed on May 30, 2012, now Pat. No. 8,980,037.

(51) Int. Cl.

| | |
|---|---|
| ***B42D 3/00*** | (2006.01) |
| ***G09F 3/00*** | (2006.01) |
| *B42D 5/00* | (2006.01) |
| *B42C 3/00* | (2006.01) |
| *B42D 15/00* | (2006.01) |
| *G09F 3/02* | (2006.01) |

(52) U.S. Cl.

CPC ..... *B42D 3/00* (2013.01); *G09F 3/0289* (2013.01); *B42C 3/00* (2013.01); *B42D 5/002* (2013.01); *B42D 15/008* (2013.01); *G09F 2003/0252* (2013.01); *G09F 2003/0273* (2013.01)

(58) Field of Classification Search

CPC ..... G09F 3/0289; G09F 2003/0252; G09F 2003/0273

See application file for complete search history.

(56) References Cited

U.S. PATENT DOCUMENTS

| | | | | |
|---|---|---|---|---|
| 4,991,878 | A | 2/1991 | Cowan et al. | |
| 5,074,595 | A * | 12/1991 | Hill et al. | 283/81 |
| RE34,366 | E | 9/1993 | Instance | |
| 5,290,616 | A | 3/1994 | Cowan et al. | |
| 5,324,559 | A | 6/1994 | Brombacher | |
| 5,588,239 | A | 12/1996 | Anderson | |

(Continued)

FOREIGN PATENT DOCUMENTS

| | | |
|---|---|---|
| GB | 2303351 | 2/1997 |

OTHER PUBLICATIONS

International Search Report and Written Opinion from International Stage Application No. PCT/US2013/070939.

(Continued)

*Primary Examiner* — Gary C Hoge

(74) *Attorney, Agent, or Firm* — Keusey & Associates, P.C.

(57) ABSTRACT

An extended content booklet label having a substrate, a folded booklet and overlaminate. The overlaminate is applied to secure the multi-up book to the substrate. The area between the booklet and the substrate is devoid of adhesive so that the substrate can conform to the shape of a container without interference from the booklet. The booklet is held closed against the substrate by the overlaminate which extends beyond the booklet to adhere to the substrate or the container. The overlaminate can pivot away from the container to an open position where the booklet can be unfolded to access all of the pages.

17 Claims, 13 Drawing Sheets

(56) References Cited

U.S. PATENT DOCUMENTS

| | | | | |
|---|---|---|---|---|
| 5,685,530 | A | 11/1997 | DeLise | |
| 5,813,700 | A | 9/1998 | Vijuk et al. | |
| 5,830,550 | A * | 11/1998 | Treleaven et al. | 428/40.1 |
| 5,846,623 | A * | 12/1998 | Denny | B31D 1/021 281/2 |
| 5,860,238 | A | 1/1999 | Anderson | |
| 5,866,219 | A * | 2/1999 | McClure et al. | 428/40.1 |
| 6,027,598 | A | 2/2000 | Anderson | |
| 6,179,335 | B1 | 1/2001 | DeLise, Jr. | |
| 6,213,520 | B1 | 4/2001 | Treleaven et al. | |
| 6,432,499 | B1 | 8/2002 | Roth et al. | |
| 6,432,500 | B1 | 8/2002 | Jones et al. | |
| 6,439,614 | B1 | 8/2002 | Cowan | |
| 6,576,315 | B2 | 6/2003 | Treleaven et al. | |
| 6,712,398 | B1 | 3/2004 | Fox et al. | |
| 6,737,137 | B2 | 5/2004 | Franko, Sr. et al. | |
| 6,948,743 | B1 | 9/2005 | Peterson | |
| 7,947,351 | B1 * | 5/2011 | Cowan | 428/40.1 |
| 2001/0011821 | A1 | 8/2001 | Lind | |
| 2002/0122910 | A1 * | 9/2002 | Grosskopf et al. | 428/40.1 |
| 2004/0157026 | A1 * | 8/2004 | Barry | 428/40.1 |
| 2011/0223368 | A1 * | 9/2011 | Zietlow et al. | 428/42.1 |

OTHER PUBLICATIONS

International Search Report and Written Opinion from Int'l. Stage PCT Application No. PCT/US2013/070951 dated Apr. 25, 2014.

* cited by examiner

FIG. 2A
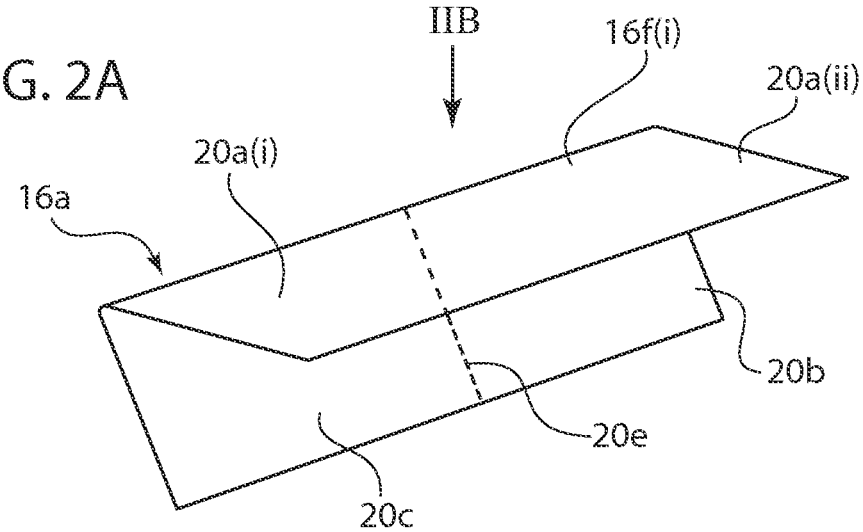
FIG. 2B
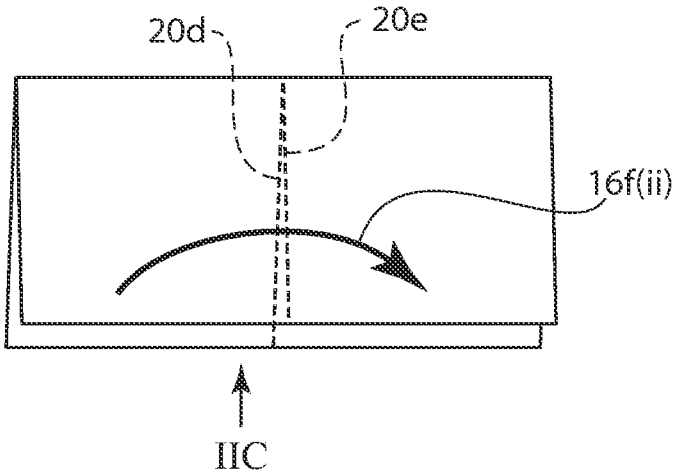
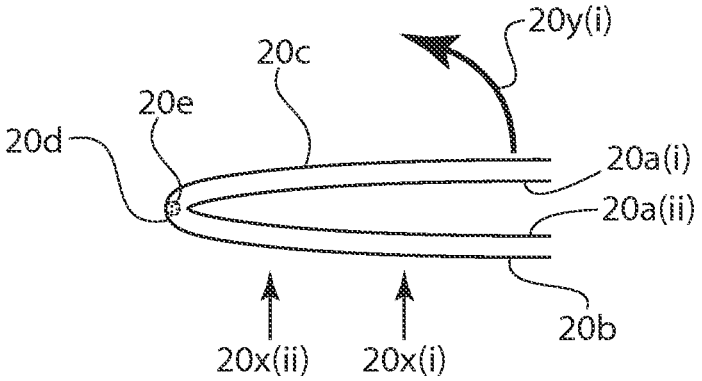
FIG. 2C

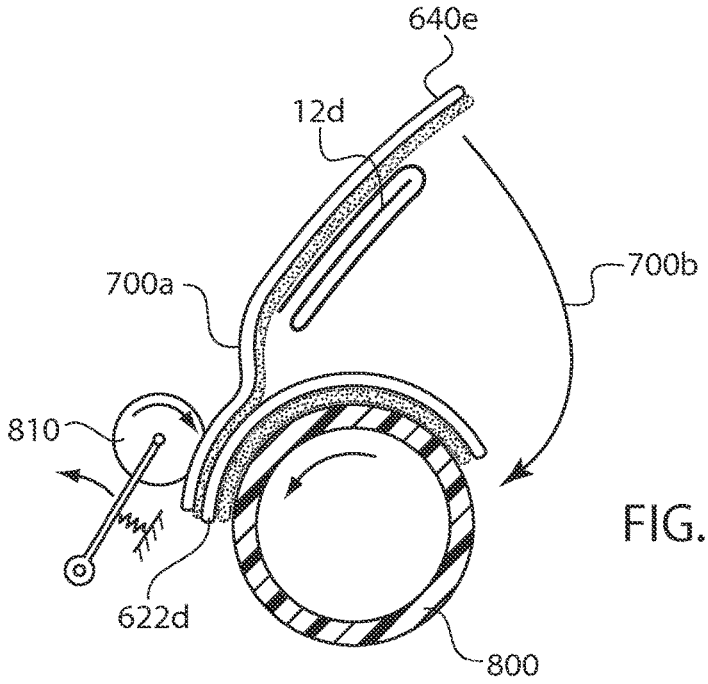
FIG. 8A
FIG. 8B
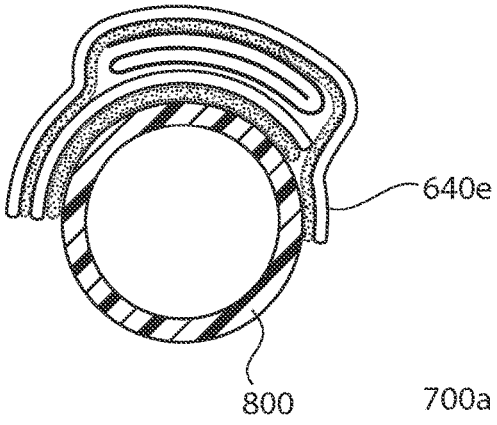
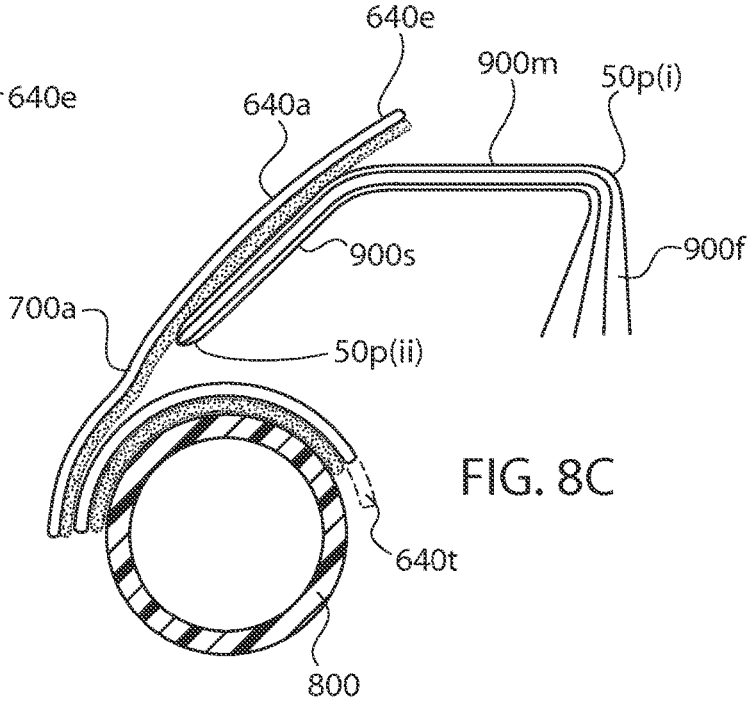
FIG. 8C

EXTENDED CONTENT BOOKLET LABELS

CROSS REFERENCE TO RELATED APPLICATION

This application is a Continuation-In-Part of co-pending U.S. patent application Ser. No. 13/483,355 entitled Method for Manufacturing Extended Content Booklet Labels filed on May 30, 2012.

BACKGROUND OF THE INVENTION

1. Field of the Invention

The invention relates to an extended content booklet labels (ECBL).

2. The Prior Art

Frequently product containers are identified by applying an adhesive-backed label to an outer surface of the container. Such labels retain their product-identifying purpose by remaining permanently affixed to the container.

Certain products which require extensive instructions or which are subject to significant government regulations require additional printed matter which is typically inserted into the product container. In the case of pharmaceuticals, the printed matter may be in the form of printed sheets, printed inserts, or printed outserts. An example of such may be seen in U.S. Pat. No. 5,685,530. While these various forms of printed matter have the benefit of providing a relatively large amount of information, their overall effectiveness is limited if they become separated from the product container.

U.S. Pat. No. 5,830,550 entitled Booklets and Self Adhesive Labels Including the Same shows single labels and multi-up booklets adhered to a continuous web. A label product including a release liner having an upper surface and a booklet disposed on the upper surface of the release liner. The booklet includes an outer piece including a top panel and a bottom panel joined by an outer fold, an inner piece disposed between the top and bottom panels having a pair of interior panels joined by an inner fold, attaching means coupling the outer and inner pieces to one another at the outer and inner folds, and a tear line formed in the bottom panel adjacent the outer fold. A layer of adhesive is interposed between the bottom panel and the upper surface of the release liner.

U.S. Pat. No. 6,576,315 entitled Multi-Ply Resealable Label shows booklets with windows adhered to a continuous web. A label includes a base label having upper and lower opposed surfaces and first and second opposed ends. A base adhesive coats the lower surface of the base label. A top panel overlies the upper surface of the base label and is joined to the base label adjacent the first end. The top panel has an upper surface. A tab having upper and lower opposed surfaces overlies the upper surface of the base label. An adhesive patch is interposed between the base label and the tab adjacent the second end. The adhesive patch secures the lower surface of the tab to the upper surface of the base label. A laminate cover overlies the top panel and the tab. A laminate adhesive secures the laminate cover to the upper surface of the top panel and releasably joins the laminate cover to the upper surface of the tab.

U.S. Pat. No. 6,432,500 entitled Label with Booklet shows a label with an overlaminate that extends beyond the label perimeter. A label with booklet comprises a liner material and a label having an upper and lower surface located on the liner. The label is secured to the liner by an adhesive layer on its lower surface such that the label can be peeled off the liner with the adhesive remaining on the lower surface of the label. A booklet is affixed to the upper surface of the label and comprises a plurality of stacked pages having edges including a top page and a bottom page, each of the pages being coextensive with each other and of smaller dimensions than the label. The booklet further comprises a cover member entirely covering the top page and extending beyond at least two opposing edges of the top page, the cover member having an upper non-adhesive surface, and a lower surface having an adhesive thereon by means of which the lower surface of the cover member is permanently adhered to the upper surface of the top page. The booklet is completely removable from the label by removing at least a portion of the cover member.

U.S. Pat. No. 6,432,499 entitled Nested Label shows a label with die cut windows applied to a release liner. A nested label includes a liner having a surface release, and a label removably bonded to the liner by an adhesive. The liner and label have respective die cuts spaced apart from each other at a skip in the liner release for obtaining different bond strengths between the label and liner on opposite sides of the label die cut.

U.S. Pat. No. 6,948,743 entitled Multilayer Label and Method of Making Same shows multi-page labels with staggered sheets to facilitate application to curved containers. A multiple layer label and a method of making the same are provided. Specifically, a label having a base layer for adhering to a container is provided wherein the label has an overcoat layer having an end that is removably adhered to the container. Moreover, the end that is removably adhered to the container is grasped by a user of the label and pulled, thereby removing the end of the overcoat layer from the container and swinging the layer away from the remainder of the label and exposing sublayers beneath the overcoat layer. The overcoat layer is adhered directly to the base layer, and at least portions of the sublayers. Each of the overcoat layer, sublayers, and the base layer may have indicia printed thereon for communicating information.

U.S. Pat. No. 6,179,335 entitled Product Label Bearing an Instructional Booklet shows a folded booklet adhered to a portion of a label. A two part identifying and instructional booklet having a label part and a booklet part. The front of the label has a small unvarnished region. The booklet is folded and glued closed with the free edges secured interiorly. An adhesive is printed onto the unvarnished region of the label and the folded booklet is adhered to the unvarnished region. The booklet has a tab portion to facilitate opening of the book during use. The tab portion faces the identifying portion of the label which extends longitudinally outwardly from the unvarnished region. The label may be placed onto a cylindrical container and bent in the longitudinal direction whereby the spine and folds of the booklet remain straight, flat and parallel to each other.

U.S. Pat. No. 6,439,614 entitled Nested Leaflet Label Structure shows a booklet adhered to a label. A nested leaflet label structure having an enhanced information carrying capacity. The nested leaflet label structure includes a base panel having a front face. A first leaflet is adjacent to the front face and comprises a first folded panel having a first fold extending substantially parallel to the first axis of the label structure. The first fold divides the first folded panel into a pair of first leaves each having inner and outer page faces. A second leaflet comprises a second folded panel having a second fold extending substantially parallel to the first axis of the label structure. The second fold divides the second folded panel into a pair of second leaves each having inner and outer page faces. A laminating layer overlies the base panel and the first leaflet. The second leaflet is nested in the first leaflet. An assembling adhesive adheres the second leaflet to the first leaflet.

Fold-out labels made from single sheets are shown in U.S. Pat. No. Re. 34,366 and U.S. Pat. No. 5,830,550. An example of a booklet which incorporates certain advantages of a label is disclosed in U.S. Pat. No. 5,324,559. The patent discloses a relatively simple booklet containing four sheets, i.e., eight pages. In all of these patents, the first page contains information which would otherwise be placed on the product label. The entire back page is adhered to the container leaving only the intermediate pages for instructional information. A further drawback of these patents lies in the fact that if their first page becomes detached from the booklet the product container would be unlabeled. U.S. Pat. No. 6,712,398 shows method for making removable inserts. U.S. Pat. No. 6,737,137 describes a method for manufacturing adhesive image transfer labels.

Accordingly, it would be desirable to provide an identifying and instructional document which combines the permanent nature of an adhesive label with the instructional capacity of a multi-page booklet.

SUMMARY OF THE INVENTION

Accordingly, it is an object of the present invention to provide compact labels containing large amounts of information.

It is another object to provide booklets that are compactly mounted to labels.

It is a further object to provide an extended content booklet that does not interfere with the label conforming to a cylindrical surface when adhered to a container.

According to a first embodiment of the invention, there is provided an extended content booklet label having a substrate, booklet and overlaminate. The substrate has an upper surface devoid of adhesive and a lower surface, wherein the upper surface includes at least a first portion and a second portion. The booklet has a spine and two or more sheets held together at the spine and extending from the spine in a longitudinal direction and including free edges which are spaced from and parallel to the spine. The booklet is divided into three sections along the longitudinal direction including a spine section, a middle section and a free edge section. The free edge section is first folded to overlie the middle section. The spine section is second folded to overlie the free edge section to form a folded booklet having the spine section on top, the middle section on the bottom, and the free edge section sandwiched therebetween. The middle section is placed directly on a first portion of the upper surface of the substrate in a free-sliding arrangement that is devoid of adhesive.

The overlaminate has a lower surface covered with adhesive to adhere to (i) the spine section of the folded booklet and (ii) a second portion of the upper surface of the substrate to hingedly connect the booklet to the substrate to form an extended content booklet label. The lower surface of the substrate is adapted to conform to the curvature of a cylindrical container without interference from the booklet.

A release liner and a layer of adhesive is disposed on the lower surface of the substrate. The substrate includes a label with its lower surface removably adhered to the release liner. The release liner is a continuous web with a multiple extended content booklet labels adhered thereto in a spaced relationship from one another. The substrate is larger than the folded booklet. The substrate includes indicia printed on the second portion of the upper surface of the substrate. The overlaminate is translucent to allow viewing of (i) the indicia printed thereunder and (ii) the spine section of the booklet. The overlaminate includes a first portion adhered to the folded booklet, a second portion adhered to the substrate, and a hinge portion disposed between the first and second portions.

The spine of the booklet is disposed adjacent the hinge portion of the overlaminate. The overlaminate includes a tab portion which extends beyond the folded booklet. The second fold of the booklet is disposed adjacent the tab portion of the overlaminate. The substrate includes a third portion that extends beyond the first portion, and wherein the tab is removably adhered to the third portion of the substrate. The second fold of the booklet is aligned with the edge of the substrate, and wherein the tab extends beyond the substrate.

The overlaminate is configured to pivot along its hinge portion between: (i) an open position in which the first portion of the overlaminate and the adhered folded booklet is pivoted away from the substrate; and (ii) a closed position in which the folded booklet can conform to the curvature of a cylindrical container independent of the substrate. In the open position, the second fold is adapted to swing the middle section of the booklet toward tab. The spine is adjacent the first fold. The booklet folds form three approximately equal size sections. The booklet folds form three sections of different sizes, wherein the middle section is longer than the free edge section and shorter than the spine section. The spine and middle sections form a ramp up on one side of the booklet leading to the central portion of the booklet which includes the spine, free edge and middle sections, and wherein the spine section forms a ramp down on the other side of the booklet leading from the central portion. The ramp up is two sections thick, and the central portion is three sections thick, and the ramp down is one section thick.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views:

FIGS. 2A-2F are a series of views showing a second embodiment of a booklet used in the label product according to the invention.

FIGS. 8A-8C are bottom views of a label adhered to a plastic bottle with the overlaminate in various positions.

DETAILED DESCRIPTION OF THE PREFERRED EMBODIMENTS

Figure 1A:
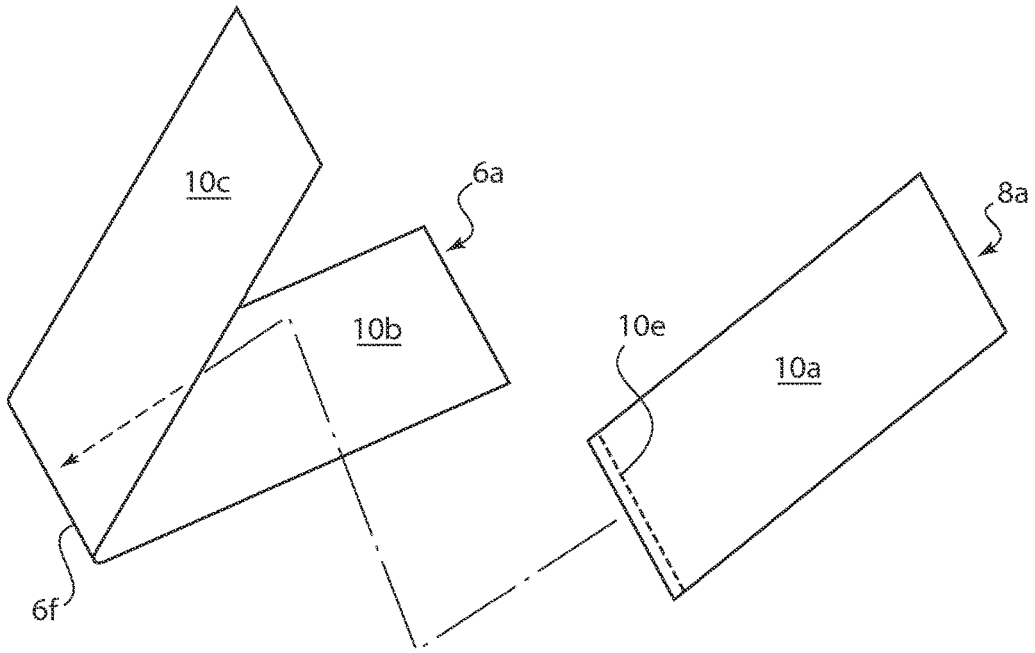
FIGS. 1A-1E are a series of views showing a first embodiment of a booklet used in the label product according to the invention.

In this application a "booklet" means an individual instructional piece having a cover sheet, a back sheet and at least one internal sheet. A sheet is a piece of paper having two opposed pages. The smallest booklet featuring one cover sheet (2 pages), one internal sheet (2 pages) and one back sheet (2 pages) would have a total of six pages. Additional internal sheets can be added. A booklet with two internal sheets would have a total of eight pages.

Booklets may be formed from one large sheet and one medium sheet by folding the large sheet in half and inserting the medium sheet into the fold. Such a booklet would have three sheets for a total of six pages.

The booklet may be formed by securing sheets and pages together at the binding by adhesive, glue or other suitable connection means. The booklet may have perforations at various locations on different sheets, to provide pages which can be removed from the book.

Booklets may be formed from one large sheet folded multiple times. The simplest example would be one sheet folded in half, and then folded in half again in a perpendicular direction. Such a booklet would have four sheets for a total of eight pages. The large sheet is bound together at the binding during the first folding step so that when the first fold is trimmed off the sheets remain connected together. Booklets with a greater number of sheets/pages may be provided by folding the large sheet additional times.

Booklets may be formed from two large sheets. The simplest example would be two sheets folded in half and then nested together with their fold lines bound together. Such a booklet would have 4 sheets and eight pages. Each additional large sheet added to the book would contribute another 2 sheets and 4 pages. Alternatively, the two large sheets can be folded in half and stacked together with the fold lines bound together to form a so called perfect bound booklet. Again, each additional large sheet added to the book would contribute another 2 sheets and 4 pages.

Booklets may be formed from large sheets that are folded end-over-end, for example folded end-over-end twice to form a ribbon that is three sheets thick. The ribbon in then folded in half perpendicular to the end-over-end folds. Binding adhesive may not be required. The end-over-end folds are then trimmed off to form a booklet with six sheets and twelve pages. If the original large sheet is folded end-over-end three times, the resulting booklet would have eight sheets and sixteen pages. Accordingly the final number of sheets can be calculated by taking the number of end-over-end folds, adding 1, and multiplying by 2. For 4 end-over-end folds, the resulting booklet would have 10 sheets, i.e. (4+1)*2=10.

Booklets may be formed from large sheets that are accordion folded, for example accordion folded twice to form a ribbon that is three sheets thick. The ribbon in then folded in half perpendicular to the accordion folds. Binding adhesive may not be required. The accordion folds are then trimmed off to form a booklet with six sheets and twelve pages. If the original large sheet is accordion folded three times, the resulting booklet would have eight sheets and sixteen pages. Accordingly the final number of sheets can be calculated by taking the number of accordion folds, adding 1, and multiplying by 2. For 4 accordion folds, the resulting booklet would have 10 sheets, i.e. (4+1)*2=10.

The large or medium sheets used to form the booklets are preprinted with indicia before folding. The layout of the printing is designed to provide text in a particular orientation on each page in the folded booklet. In a preferred embodiment, the indicia includes pharmaceutical information about drugs that are packaged with the booklets. The books can be printed by any suitable industrial printing process, for example sheet offset, web offset, flexographic, rotary letterpress, or gravure.

In this application the term "book" refers to a printed article having two or more booklets included therein. The booklets are linearly arranged with a common spine. In addition, a book includes a waste zone in between each adjacent pair of booklets. A book may include a top waste zone disposed above the top booklet. The top waste zone includes the upper edge of the book. The top waste zone may include free sheets and/or folds. A book may include a bottom waste zone disposed below the bottom booklet. The bottom waste zone includes the lower edge of the book. The bottom waste zone may include free sheets and/or folds. By cutting and removing the waste zone(s), the various booklets will be formed from the book. Cutting a top or bottom waste zone that includes folds, will allow the sheets of the resulting booklets to be opened.

The term "multi-up" refers to the orientation of the booklets within the book when the book is disposed onto the web or substrate. The web is a continuous substrate material that is typically wound off a roll and then passes through various manufacturing stations in a longitudinal direction. Therefore, longitudinal is the direction extending along the indefinite length of the web. The width across the web is a direction that is perpendicular to the longitudinal direction. When the book is placed on the web with the booklets oriented one below the other across the width, the book is considered to be multi-up. That is, a discrete longitudinal section of the web contains two or more booklets.

Figure 1B:
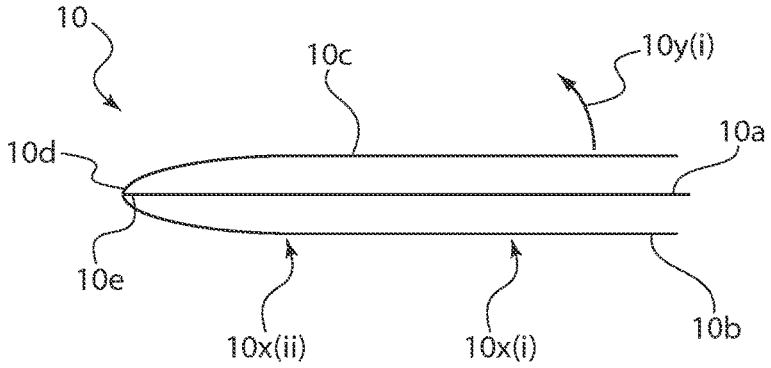

One form of a multi-up book 10 is illustrated in FIGS. 1A-1E. In the drawings, reference numerals having a 6 or 8 prefix, refer to sheets that are used to construct the book. Reference numerals with a 10 prefix refer to the completed book. Reference numerals with a 12 prefix refer to booklets, while reference numerals with a 14 prefix refer to the waste zones. FIG. 1A shows a large sheet 6*a* and a medium sheet 8*a* that are combined to form a book 10. Considering the final configuration of the book, sheets 6*a* and 8*a* are preprinted with indicia to create properly oriented text and images for the various booklets that will be part of the multi-up book. Large sheet 6*a* is folded in half (or twice folded in thirds or additionally folded in other fraction) to form fold 6*f*. Glue 10*e* is applied to secure medium sheet 8*a* to the inside of fold 6*f*. The resulting book 10 is shown in FIG. 1B. The large sheet now forms cover sheet 10*c* and back sheet 10*b*. The medium sheet now forms internal sheet 10*a*. The resulting book has six pages: the front of cover sheet 10*c*, the back of cover sheet 10*c*, the front of internal sheet 10*a*, the back of internal sheet 10*a*, the front of back sheet 10*b*, and the back of back sheet 10*b*.

Glue for the spine of the books may be selected from various adhesives used in paper converting or corrugated applications that are approved for use in pharmaceutical packaging. Such adhesive may be water-based synthetic resins, for example, WB8147M available from H.B. Fuller of St. Paul, Minn.

The resulting book can be increased in size by adding sheets (to create two additional pages per sheet). For example, to increase to an 8 page book, large sheet 6*a* can be combined with a further large sheet. The two large sheets can be folded like sheet 6*a* and nested together with a line of glue at the fold line. Alternatively, the two large sheets can be placed on top of each other and glued together at the spine, in a perfect bound arrangement. To further increase the number of sheets, medium sheets (similar to medium sheet 8*a*) can be added to form a 10 page book, for example. In this manner, books with increasing number of [paired] pages can be formed by combining 1, 2, 3 or more large sheets and 1 or more medium sheets. In lieu of two medium sheets, one could simply add a folded large sheet.

Figure 1C:
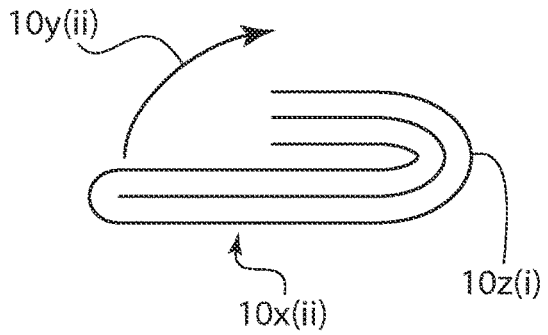
Figure 1D:
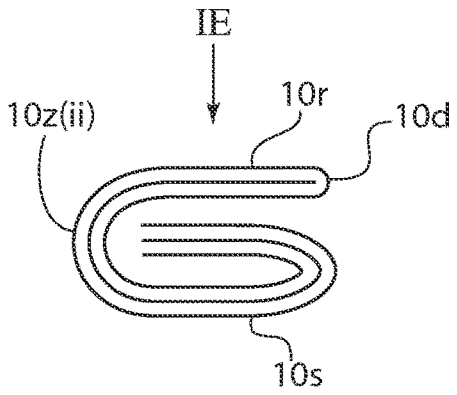

The book shown in FIG. 1B is fully assembled and as a multi-up book (or log) it contains two or more booklets, each with a complete set of instructions or indicia. To prepare book 10 for use in the subsequent manufacturing steps, it is desirable to tuck in the free edges to streamline the book for further handling. Book 10 is divided into three sections with two fold locations designated as 10*x*(*i*) and 10*x*(*ii*). The arrow 10*y*(*i*) indicates the fold direction as the book is initially folded at first fold location 10*x*(*i*). FIG. 1C shows the resulting configuration with a completed first fold 10*z*(*i*). The arrow 10*y*(*ii*) indicates the fold direction as the book is subsequently folded at second fold location 10*x*(*ii*). FIG. 1D shows the resulting configuration with a completed second fold 10*z*(*ii*). Note the free ends of the sheets are tucked inside the book so as to avoid interference with the processing and handling equipment. As will be explained in greater detail below, the folded book 10 includes an upper surface 10*r* that will be adhered to the overlaminate, and a lower surface 10*s* that will be placed on the web and selectively adhered thereto.

Figure 1E:
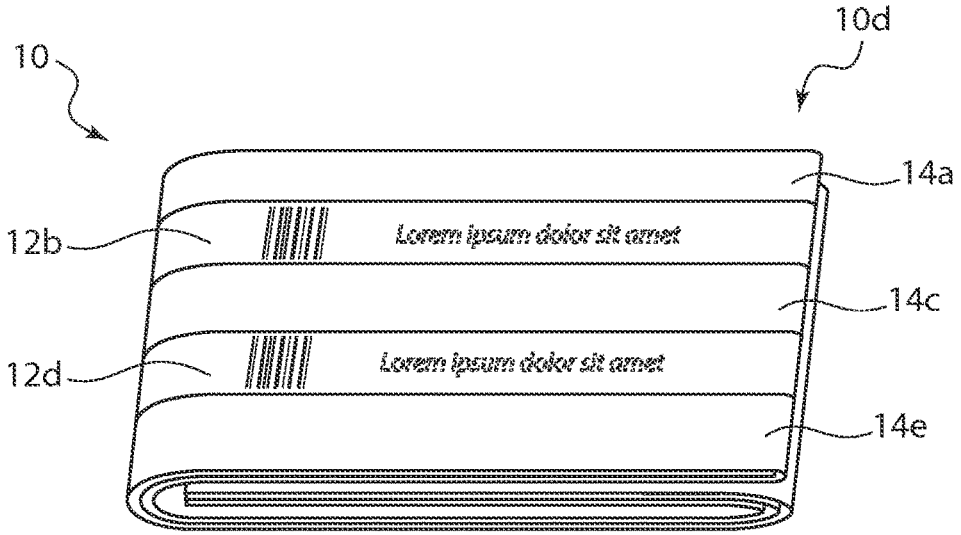

Referring to a top view of the folded book, FIG. 1E shows book 10 with two booklets 12*b*, 12*d* alternating with a top waste zone 14*a*, a waste zone 14*c* and a bottom waste zone 14*e*.

Multi-up books are an efficient way to print and fold multiple books. The booklet labels described in this application use a single booklet. Booklets for the labels can be produced by forming a book 10 and trimming off the waste zones. Alternatively, by adjusting the printing and size of the sheets, the resulting item 10 can be a single folded booklet.

The books are made from paper referred to as offset stock having a paper weight between 22# and 60#. The # designation is a measure of paper density measured in pounds per basis ream of 500 sheets of 17" by 22" paper. Such paper may be obtained from Twin Rivers Paper Company of South Portland, Me. or Finch Paper, LLC of Glen Falls, N.Y. For example Twin Rivers supplies 22# Custom Plus and 27#, 30#, 35#, 40# Pharmopaque—Regular Finish. Finch supplies 40# Finch Opaque—Wove Finish and 60# Finch Opaque—Vellum Finish. The preferred paper is Twin Rivers 27# Pharmopaque—Regular Finish.

Figure 2D:
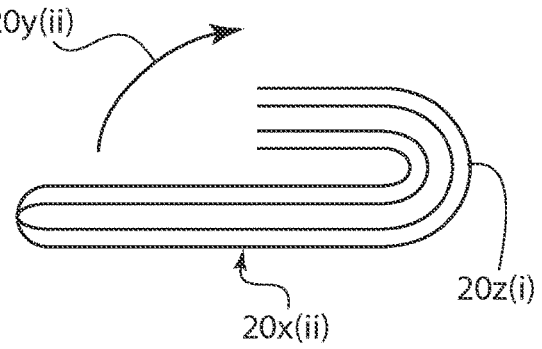

Another form of a multi-up book 20 having 4 sheets and 8 pages made from a single large sheet 16 is shown in FIGS. 2A-2F. In these drawings, reference numerals having a 16 prefix, refer to sheet(s) that are used to construct the book. Reference numerals with a 20 prefix refer to the completed book. Reference numerals with a 22 prefix refer to booklets, while reference numerals with a 24 prefix refer to the waste zones. FIG. 2A shows a large sheet 16*a* pre-printed with indicia to create properly oriented text and images for the various booklets that will be part of the multi-up book. Large sheet 16*a* is folded in half to form fold 16*f*(*i*). Glue 20*e* is applied to secure two linear sections of the folded sheet 16*a* together. As can be most easily seen in FIGS. 2B and 2C, the glue line 20*e* will form the spine 20*d* of the book. The sheet is then folded in half again as indicated by arrow 16*f*(*ii*). When the two folds are completed, the large sheet 16*a* forms cover sheet 20*c*, internal sheets 20*a*(*i*) and 20*a*(*ii*), and back sheet 20*b*. The resulting book has eight pages: the front & back of cover sheet 20*c*, the front and & back of internal sheet 20*a*(*i*), the front and back of internal sheet 20*a*(*ii*), and the front and back of back sheet 20*b*.

The resulting book can be increased in size by adding sheets. For example, another one or more large sheet(s) like 16*a* can be folded and nested within large sheet 16*a* and/or laid on top of 16*a*. Using two large sheets like 16*a* would provide a book with 8 sheets and 16 pages. Alternatively, a medium sheet which is half the size of large sheet 16*a* can be tucked into the fold and adhered top and bottom with a pair of glue lines similar to 20*e*. One large sheet and one medium sheet would provide a book with 6 sheets and 12 pages. In this manner, books with increasing number of [paired] pages can be formed by combining 1, 2, 3 or more large sheets and 1 or more medium sheets. In lieu of two medium sheets, one could simply add a folded large sheet.

Figure 2E:
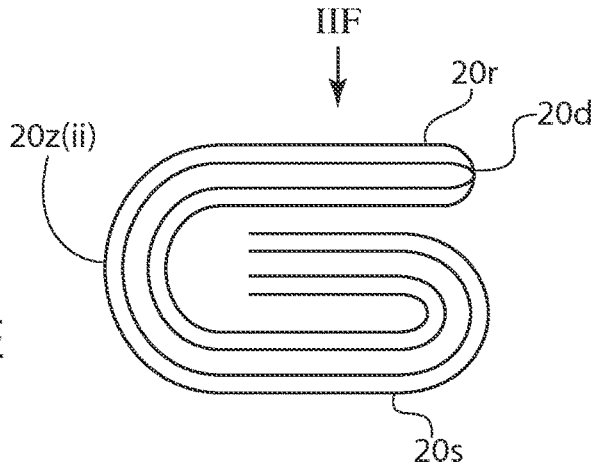

The book shown in FIG. 2C is fully assembled and as a multi-up book it contains two or booklets, each with a complete set of instructions or indicia. In a subsequent step, the top fold 16*f*(*i*) will be trimmed off to allow the pages of book 20 to open and separate from each other. To prepare book 20 for use in the subsequent manufacturing steps, it is desirable to tuck in the free edges to streamline the book for further handling. Book 20 is divided into three sections with two fold locations designated as 20*x*(*i*) and 20*x*(*ii*). The arrow 20*y*(*i*) indicates the fold direction as the book is initially folded at first fold location 20*x*(*i*). FIG. 2D shows the resulting configuration with a completed first fold 20*z*(*i*). The arrow 20*y*(*ii*) indicates the fold direction as the book is subsequently folded at second fold location 20*x*(*ii*). FIG. 2E shows the resulting configuration with a completed second fold 20*z*(*ii*). Note the free ends of the sheets are tucked inside the book so as to avoid interference with the processing and handling equipment. As will be explained in greater detail below, the folded book 20 includes an upper surface 20*r* that will be adhered to the overlaminate, and a lower surface 20*s* that will be placed on the web and selectively adhered thereto.

Figure 2F:
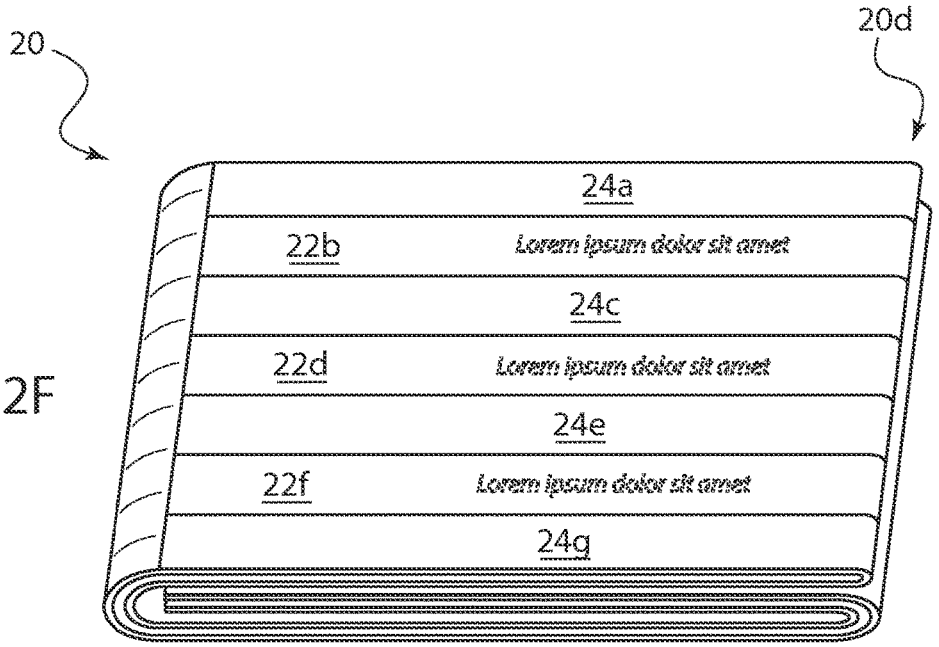

Referring to a top view of the folded book, FIG. 2F shows book 20 with three booklets 22*b*, 22*d*, 22*f* alternating with a top waste zone 24*a*, intermediate waste zones 24*c*, 24*e* and a bottom waste zone 24*g*. As mentioned earlier, top waste zone 24*a* contains fold 16*f*(*i*) and will be trimmed off.

Multi-up books are an efficient way to print and fold multiple books. The booklet labels described in this application use a single booklet. Booklets for the labels can be produced by forming a book 20 and trimming off the waste zones. Alternatively, by adjusting the printing and size of the sheets and trimming off fold 16*f*(*i*), the resulting item 20 can be a single folded booklet.

Figure 3A:
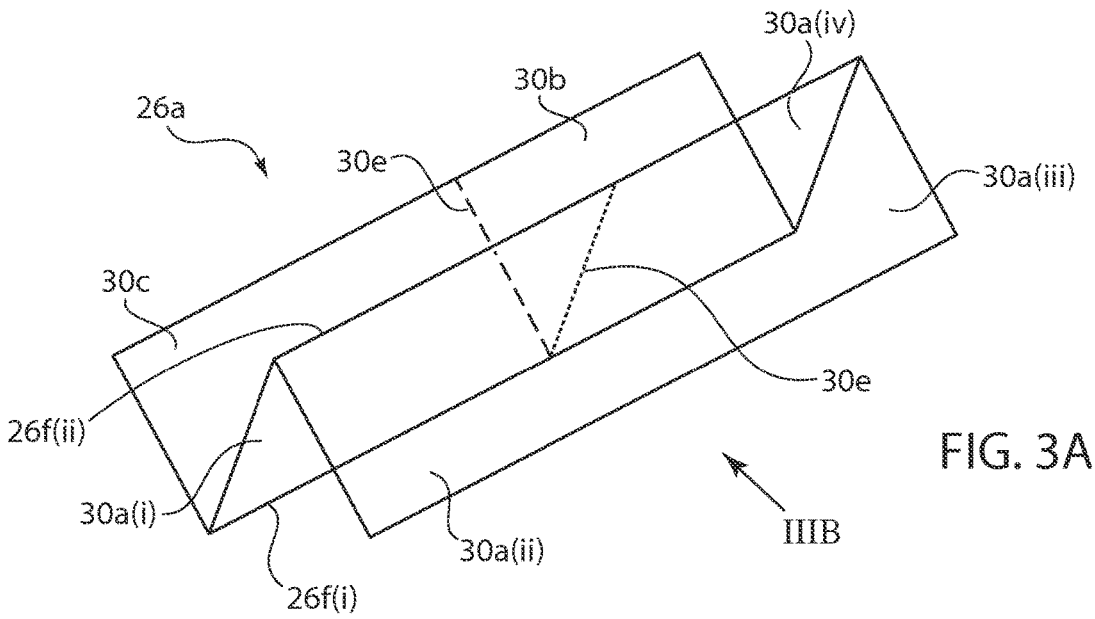
FIGS. 3A-3F are a series of views showing a third embodiment of a booklet used in the label product according to the invention.
Figure 3B:
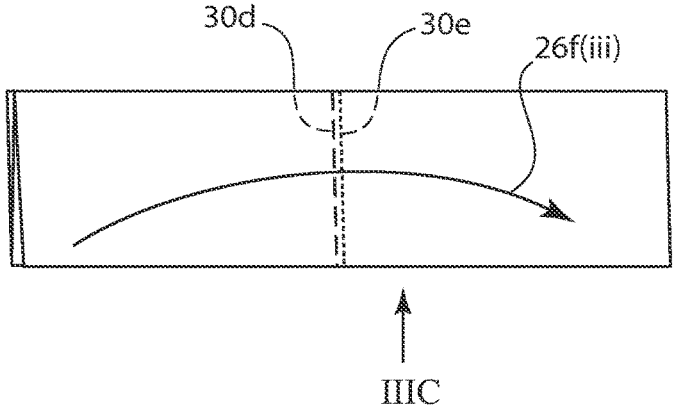

Another form of a multi-up book 30 having 6 sheets and 12 pages made from a single large sheet 26 is shown in FIGS. 3A-2F. In these drawings, reference numerals having a 26 prefix, refer to sheet(s) that are used to construct the book. Reference numerals with a 30 prefix refer to the completed book. Reference numerals with a 32 prefix refer to booklets, while reference numerals with a 34 prefix refer to the waste zones. FIG. 3A shows a large sheet 26*a* pre-printed with indicia to create properly oriented text and images for the various booklets that will be part of the multi-up book. Large sheet 26 is accordion folded twice in thirds to form folds 26*f*(*i*) and 26*f*(*ii*). Glue 30*e* is applied within both folds. Each glue line secures two linear sections of the accordion folded sheet 26 together. As can be most easily seen in FIGS. 3B and 3C, the glue line 30*e* will form the spine 30*d* of the book. The sheet is then folded in half again as indicated by arrow 26*f*(*iii*). When the three folds are completed, the large sheet 26 forms cover sheet 30*c*, internal sheets 30*a*(*i*) and 30*a*(*ii*) and 30*a* (*iii*) and 30*a*(*iv*), and back sheet 30*b*. The resulting book has twelve pages: the front & back of cover sheet 30*c*, the front and & back of internal sheets 30*a*(*i*) through 30*a*(*iv*), and the front and back of back sheet 30*b*.

The resulting book can be increased in size by adding folds. For example, another one or a larger sheet like 26 can be accordion folded three or more times to produce four or more panels, respectively. That is the total number of folds of form 26*f*(*i*), can be represented by ii, iii, iv . . . n. Where the number of panels would be represented by 3, 4, 5 . . . n+1.

In this manner, books with increasing number of [paired] pages can be formed by an increasing number of accordion folds.

Figure 3C:
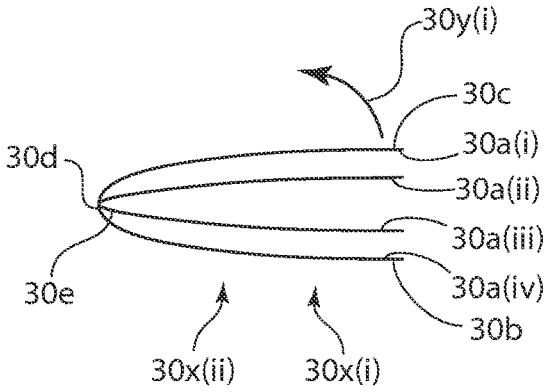
Figure 3D:
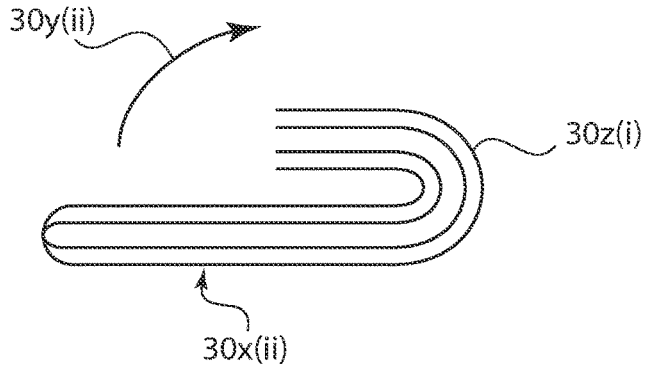
Figure 3E:
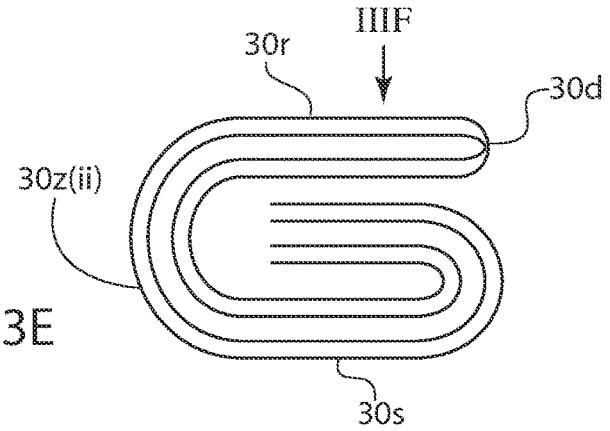

The book shown in FIG. 3C is fully assembled and as a multi-up book it contains two or booklets, each with a complete set of instructions or indicia. In a subsequent step, the top fold 26*f*(*ii*) will be trimmed off to allow the pages of book 30 to open and separate from each other. If additional folds are present along the top edge of book 30, they will likewise be trimmed off. Similarly, the bottom fold 26*f*(*i*) will be trimmed off along with any additional folds present at the bottom edge of book 30. To prepare book 30 for use in the subsequent manufacturing steps, it is desirable to tuck in the free edges to streamline the book for further handling. Book 30 is divided into three sections with two fold locations designated as 30*x*(*i*) and 30*x*(*ii*). The arrow 30*y*(*i*) indicates the fold direction as the book is initially folded at first fold location 30*x*(*i*). FIG. 3D shows the resulting configuration with a completed first fold 30*z*(*i*). The arrow 30*y*(*ii*) indicates the fold direction as the book is subsequently folded at second fold location 30*x*(*ii*). FIG. 3E shows the resulting configuration with a completed second fold 30*z*(*ii*). Note the free ends of the sheets are tucked inside the book so as to avoid interference with the processing and handling equipment. As will be explained in greater detail below, the folded book 30 includes an upper surface 30*r* that will be adhered to the overlaminate, and a lower surface 30*s* that will be placed on the web and be selectively adhered thereto.

Figure 3F:
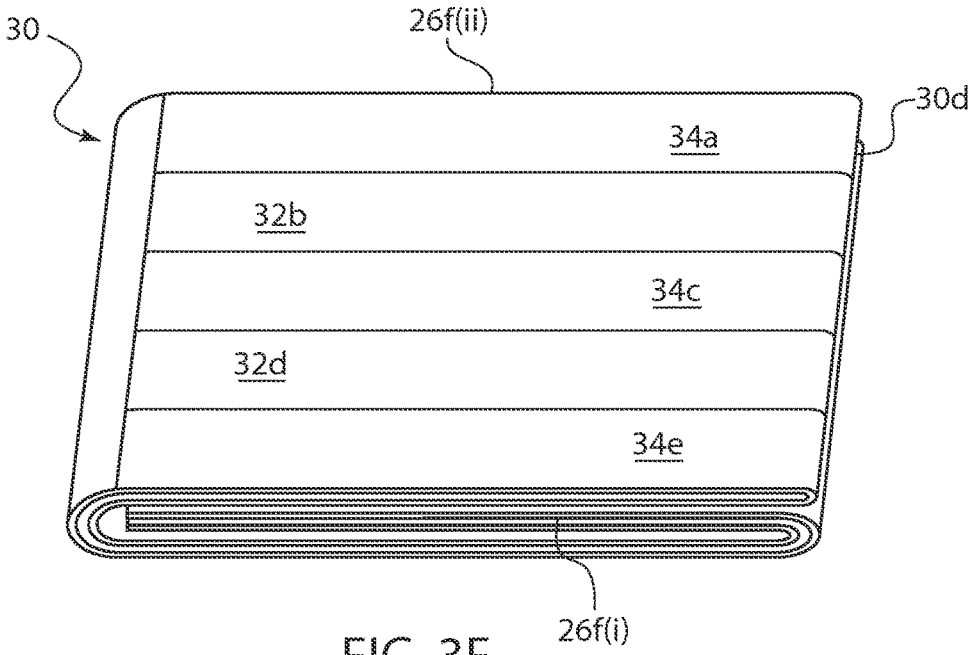

Referring to a top view of the folded book, FIG. 3F shows book 30 with two booklets 32*b*, 32*d* alternating with a top waste zone 34*a*, an intermediate waste zone 34*c*, and a bottom waste zone 34*g*. As mentioned earlier, top waste zone 34*a* contains fold 26*f*(*ii*) and will be trimmed off. Bottom waste zone 34*e* contains fold 26*f*(*i*) and will be trimmed off.

Multi-up books are an efficient way to print and fold multiple books. The booklet labels described in this application uses a single booklet. Booklets for the labels can be produced by forming a booklet and trimming off the waste zones. Alternatively, by adjusting the printing and size of the sheets and trimming off the folds 26*f*(*i*) and 26*f*(*ii*), the resulting item 30 can be a single folded booklet.

Figure 4A:
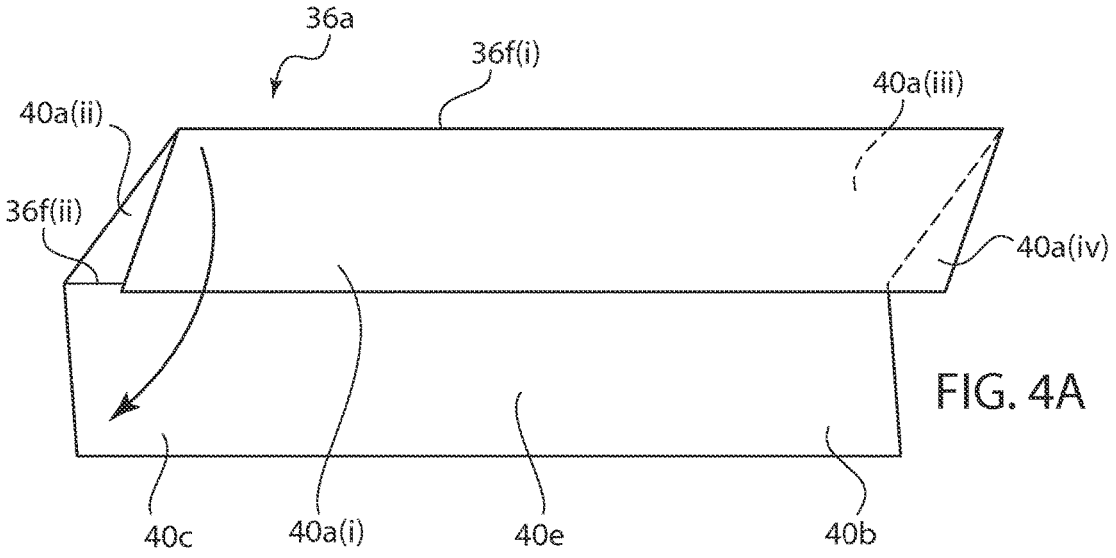
FIGS. 4A-4G are a series of views showing a fourth embodiment of a booklet used in the label product according to the invention.
Figure 4B:
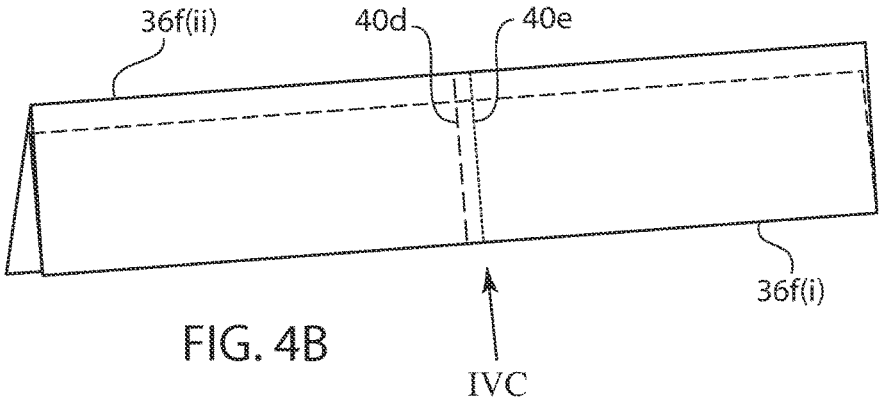
Figure 4C:
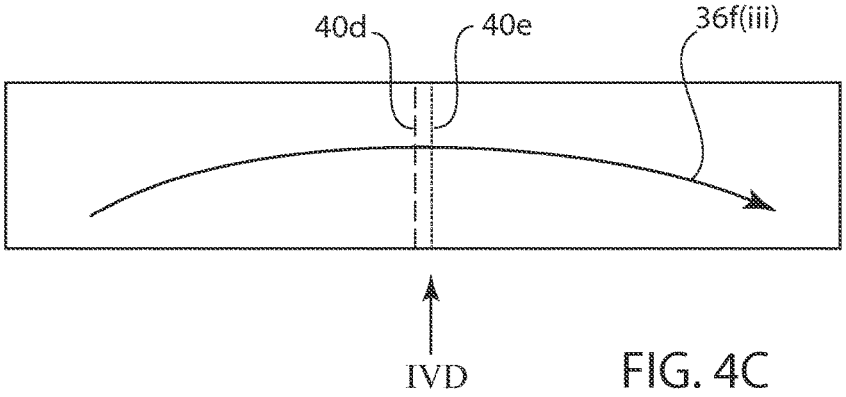

Another form of a multi-up book 40 having 6 sheets and 12 pages made from a single large sheet 36*a* is shown in FIGS. 4A-4G. In these drawings, reference numerals having a 36 prefix, refer to sheet(s) that are used to construct the book. Reference numerals with a 40 prefix refer to the completed book. Reference numerals with a 42 prefix refer to booklets, while reference numerals with a 44 prefix refer to the waste zones. FIG. 4A shows a large sheet 36*a* pre-printed with indicia to create properly oriented text and images for the various booklets that will be part of the multi-up book. Large sheet 36*a* is folded end-over-end twice in thirds to form folds 36*f*(*i*) and 36*f*(*ii*). Glue 40*e* is applied within both folds. For example, glue is applied in a line down the center of large sheet 36*a* perpendicular to the folds 36*f*. The glue line secures two linear sections of the end-over-end folded sheet 36*a* together. As can be most easily seen in FIGS. 4B, 4C and 4D, the glue line 40*e* will form the spine 40*d* of the book. The sheet is then folded in half as indicated by arrow 36*f*(*iii*). Glue line 40*e* is disposed co-linear to the final fold 36*f*(*iii*) which cooperatively form spine 40*d*. When the three folds are completed, the large sheet 26 forms cover sheet 40*c*, internal sheets 40*a*(*i*) and 40*a*(*ii*) and 40*a* (*iii*) and 40*a*(*iv*), and back sheet 40*b*. The resulting book has twelve pages: the front & back of cover sheet 40*c*, the front and & back of internal sheets 40*a*(*i*) through 40*a*(*iv*), and the front and back of back sheet 40*b*.

The resulting book can be increased in size by adding folds. For example, another one or a larger sheet like 36*a* can be folded end-over-end three or more times to produce four or more panels, respectively. That is the total number of folds of form 36*f*(*i*), can be represented by ii, iii, iv . . . n. Where the number of panels can be calculated as a function of folds as ii+1, iii+1, iv+1 resulting in the number of panels being 3, 4, 5 . . . n+1. In this manner, books with increasing number of [paired] pages can be formed by an increasing number of end-over-end folds.

Figure 4D:
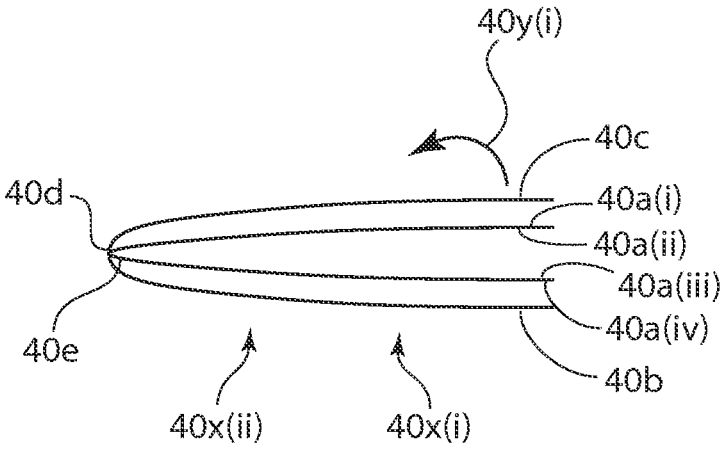
Figure 4E:
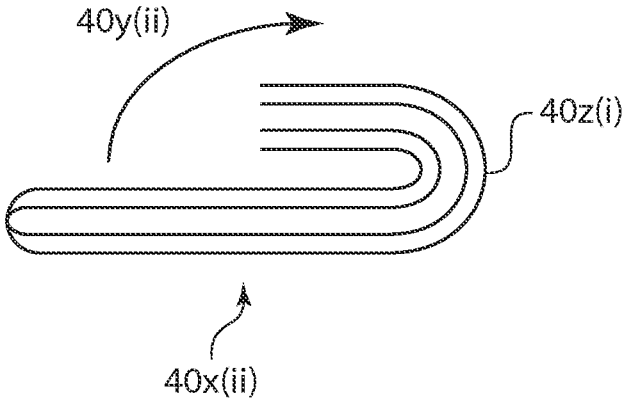
Figure 4F:
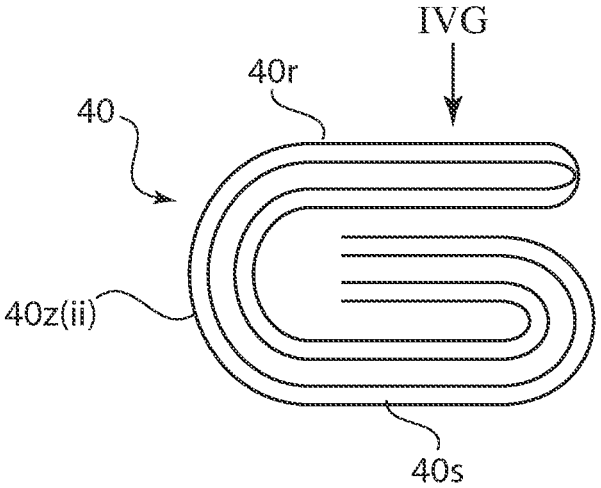

The book shown in FIG. 4D is fully assembled and as a multi-up book it contains two or more booklets, each with a complete set of instructions or indicia. In a subsequent step, the top fold 36*f*(*ii*) will be trimmed off to allow the pages of book 40 to open and separate from each other. If additional folds are present along the top edge of book 40, they will likewise be trimmed off. Similarly, the bottom fold 36*f*(*i*) will be trimmed off along with any additional folds present at the bottom edge of book 30. To prepare book 40 for use in the subsequent manufacturing steps, it is desirable to tuck in the free edges to streamline the book for further handling. Book 40 is divided into three sections with two fold locations designated as 40*x*(*i*) and 40*x*(*ii*). The arrow 40*y*(*i*) indicates the fold direction as the book is initially folded at first fold location 40*x*(*i*). FIG. 4E shows the resulting configuration with a completed first fold 40*z*(*i*). The arrow 40*y*(*ii*) indicates the fold direction as the book is subsequently folded at second fold location 40*x*(*ii*). FIG. 4F shows the resulting configuration with a completed second fold 40*z*(*ii*). Note the free ends of the sheets (which are opposite spine 40*d* as shown in FIG. 4D) are tucked inside the book so as to avoid interference with the processing and handling equipment. As will be explained in greater detail below, the folded book 40 includes an upper surface 40*r* that will be adhered to the overlaminate, and a lower surface 40*s* that will be placed on the web and remain unadhered thereto.

Figure 4G:
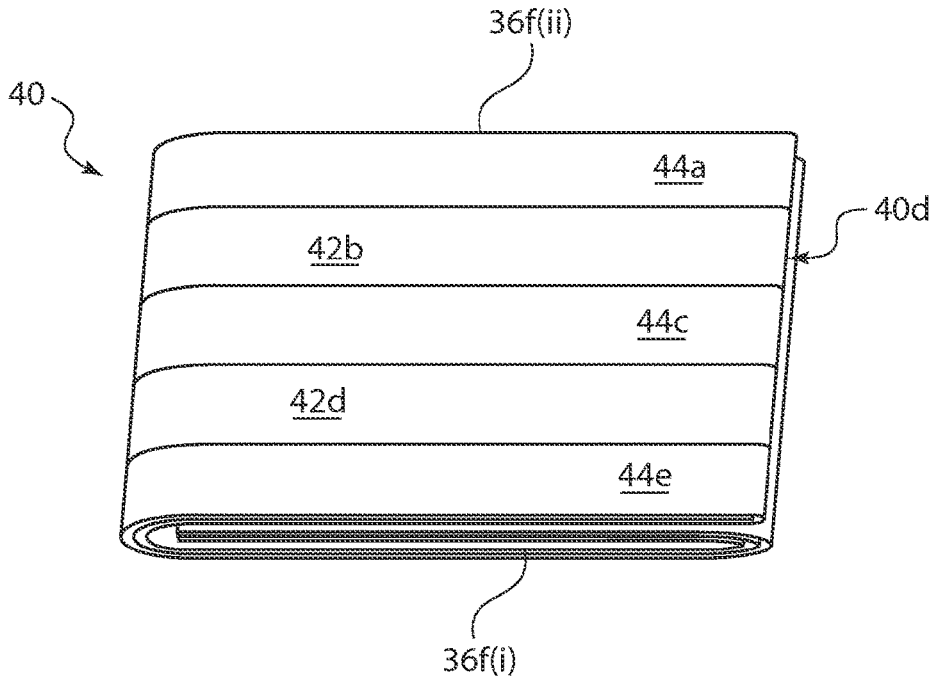

Referring to a top view of the folded book, FIG. 4G shows book 40 with two booklets 42*b*, 42*d* alternating with a top waste zone 44*a*, an intermediate waste zone 44*c*, and a bottom waste zone 44*e*. As mentioned earlier, top waste zone 44*a* contains fold 36*f*(*ii*) and will be trimmed off. If additional top folds are present, they will be trimmed off also. Bottom waste zone 44*e* contains fold 36*f*(*i*) and will be trimmed off. If additional bottom folds are present, they will be trimmed off also.

Figure 5:
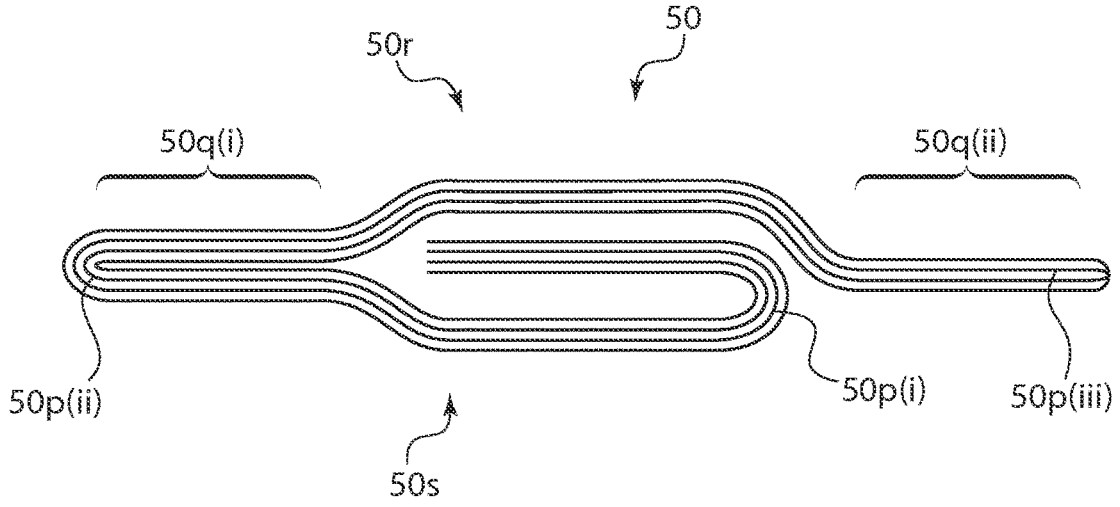
FIG. 5 is a side elevational view showing a fifth embodiment of a booklet used in the label product according to the invention.

As discussed above, FIG. 4F shows a multi-up book that is bi-folded in equal thirds to form folded book 40. An alternative configuration is shown in FIG. 5, where the multi-up book is twice folded in unequal sections to form folded book 50. Folded book 50 shows a ramp-up section

50*q*(*i*) of double thickness, a center section of triple thickness, and a ramp-down section 50*q*(*ii*) of single thickness. The ramp-up and ramp-down sections are useful in certain applications, for example with thicker books. All of the multi-up books described in this application can be folded to include the ramp-up and/or ramp-down sections. As used herein, a ramp section means a section having fewer than all panels present. The ramp sections are located at the leading or trailing edges of the multi-up book. As will be described in greater detail below, the lower section 50*s* will be placed on the web and remain unadhered, while the upper section 50*r* will be adhered to the overlaminate. The ramp sections will allow the overlaminate to layer onto the book and web with a smoother transition. That is, the overlaminate can transition off the web to a double thickness, before accommodating the triple thickness. The overlaminate can then transition to a single thickness before re-attaching to the web. As can be seen in FIG. 4F, if book 40 is very thick, gaps may form on either side as the overlaminate transitions from the web to triple thickness and then back down to the web. Books containing ramp sections may be trimmed to form booklets for use in the labels according to the invention.

Multi-up books are an efficient way to print and fold multiple books. The booklet labels described in this application uses a single booklet. Booklets for the labels can be produced by forming a booklet and trimming off the waste zones. Alternatively, by adjusting the printing and size of the sheets and trimming off the folds 36*f*(*i*) and 36*f*(*ii*), the resulting item 40 can be a single folded booklet.

Referring back to FIG. 5, the upper surface 50*r* will be adhered to the overlaminate, with all other sheets being free from the overlaminate. The book may be formed with perforation, for example, perforations running in the sheets parallel to the spine of the book. When the booklet is opened, perforation 50*p*(*i*) would allow about ⅙ of the sheet to be removed. Such perforations can be included on one or more sheets at similar or different locations. Other perforations 50*p*(*ii*) allow about a half sheet to be removed. Where perforation 50*p*(*iii*) would allow about 1 full sheet to be removed. The sheet portions that are removed could include coupons, receipts for pharmacists, hand-outs for patients, or other printed or machine-scannable documents. Each booklet could have multiple perforations on one sheet, or several perforations on different sheets. The hand-outs could be similar to each other or different. As can be appreciated, the original large sheets 6*a*, 16*a*, 26*a*, 36*a* and the medium sheets 8*a* can be preprinted and perforated to provide indicia and hand-outs in certain orientations and configurations within the individual booklets.

The extended content booklet label according to the invention includes a folded extended content booklet that is secured by an overlaminate to a substrate. The extended content booklet may be formed by various methods as described above. The extended content booklet is preferably folded 2 times, so as to enclose the fee ends within the interior of the completely folded booklet. The substrate is preferably label stock that is adhered to a release liner with adhesive. The release liner may be a continuous web with a series of extended content booklet labels adhered thereto in spaced relation to one another.

The booklets may be initially formed as books containing two or more booklets. The books are secured by an overlaminate to a label stock web and trimmed to leave a series of booklets on their own individual label. The method for securing the books, overlaminating and trimming is described in my co-pending U.S. patent application Ser. No. 13/483,355 entitled Method for Manufacturing Extended Content Booklet Labels filed on May 30, 2012, the entire contents of which is incorporated herein by reference thereto.

As a broad overview, the web passes through a printing station, a first die cutting station, an adhesive printing station, a sensor, a book dispensing station, a laminating station, a second die cutting station and a web and label take up station.

In summary, the web is processed to receive certain printing, first die cutting and adhesive application before reaching the book dispensing station. Book dispenser holds a stack of books as described above. Books are dispensed one at a time on to moving web, with slight spaces between adjacent books. Subsequently, the web carrying the books is processed to receive a laminate, second die cutting, waste laminate removal, and collecting the web-bound completed labels.

The web may be chosen from various paper or label stock. In a preferred embodiment, web 600 includes a release liner 600*a*, and a paper layer 600*b* coated with adhesive 600*c*, as shown in FIG. 6B. The release liner is a polypropylene substrate having a thickness between 0.5 mil and 4.5 mils.

Suitable labels include those having between 54# to 60# facestock.

Such label stock is available from Avery Dennison sold under the trademame Fasson®. For example, Avery Dennison supplies 54# semi-gloss facestock (paper) coated with C2500 rubber based adhesive disposed on 40# bleached, calendered kraft stock liner; and 60# semi-gloss facestock (paper) coated with S246 general purpose permanent rubber based adhesive FDA compliant with 21 CFR 175.105 disposed on 40# bleached, calendered kraft stock liner. The preferred label stock is the latter 60# semi-gloss facestock coated with S246 disposed on 40# stock liner.

Glue used to secure the waste zones of the books to the web may be selected from various adhesives used in paper converting applications that are approved for use in pharmaceutical packaging. Such adhesive may be permanent acrylic adhesive, for example, clear, permanent acrylic adhesive S8020 available from Avery Dennison sold under the tradename Fasson®.

Referring now to FIGS. 8A, 8B and 8C (collectively referred to as FIG. 8), there is shown completed extended content booklet labels. FIG. 8 shows a series of one label being adhered to a container, then fully closed, then in the process of being opened. The booklet labels can be manufactured individually, or in batches, or continuously, or any combination of these manufacturing methods. Individual booklets 12*d* may be placed on pre-cut labels 622*d* and covered with a pre-cut section of laminate 640*a*. The individual placement of booklet and laminate may be run as a two-up or multi-up process.

Figure 6A:
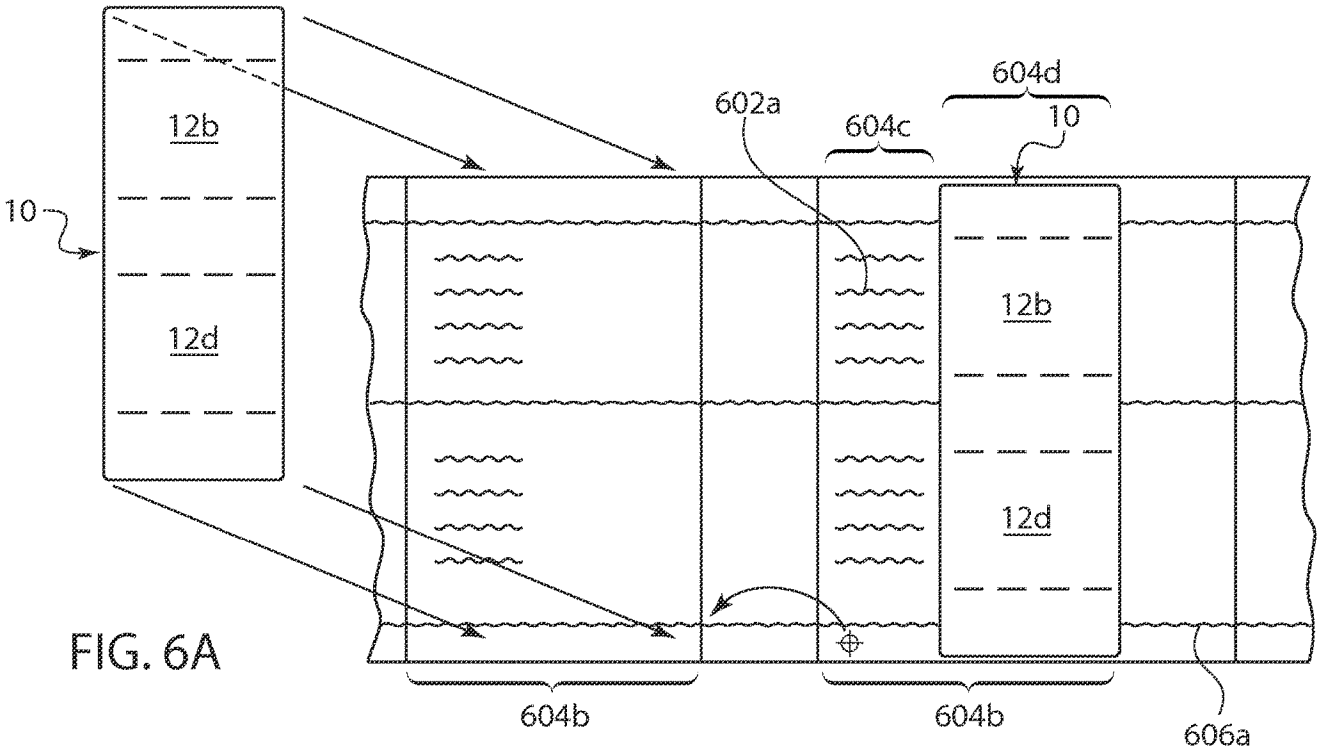
FIGS. 6A and 6B are top and side views of the booklet being placed on the substrate.
Figure 6B:
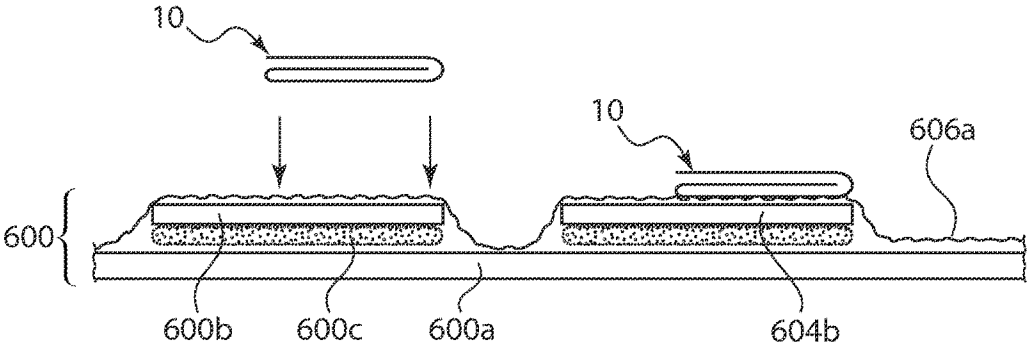

FIGS. 6A and 6B illustrate web 600 with three adhesive strips 606*a* running longitudinally along the web. The adhesive strips 606*a* are located in the waste rows passing across the cut sections and the label sections 604*b*. The waste zones 14*a, c* and *e* of the books will align with the adhesive strips 606*a* to temporarily hold the book in place on the web. It should be noted that booklets 12*b* and 12*d* will not be adhered to the web. On the right label section 604*b*, a book 10 has been adhered in place along the right edge of label section 604*b*. Label section 604*b* is divided into a printed column 604*c* and a booklet placement column 604*d*. The left side of the drawings shows a book 10 being aligned for placement on to the next available label section 604*b*. This process allows a two-up or multi-up booklets to be placed on the web in one step. Alternatively, individual booklets 12*b* may be fed in registration to their location on the paper layer and held in place until they contact the overlaminate.

Next the web with adhered books passes to a laminating station where a continuous laminate having a similar width to the web, is fed from a laminate spool and applied over the web and books. The laminate is may be opaque, translucent or transparent. If an opaque laminate is used, it may be pre-printed with indicia. In such a case, the laminate would need to be applied to the label section and book in registration. In a preferred embodiment the laminate is transparent without indicia. Accordingly, the indicia 602*a* and any printing on the upper facing surface of the book can be seen through the laminate. The laminate has a lower surface covered with adhesive and protected by a release liner. The release liner is peeled away and discarded as the laminate dispenses off the laminate spool. A press roller insures that the laminate is closely adhered to the web as it encounters the bumps going from the flat web to the books adhered to the label sections.

Suitable laminate includes facestock between 0.8 to 1 mil thick coated with adhesive disposed on a liner. Suitable laminates are available from Avery Dennison sold under the tradename Fasson®. For example, Avery Dennison supplies 0.8 mil polypropylene facestock coated with clear, permanent acrylic adhesive; and 1 mil clear printed-treated polyester coated with S8020 clear, permanent acrylic adhesive disposed on 40# bleached white glassine liner. The preferred laminate is the latter 1 mil clear printed-treated polyester coated with S8020 clear, permanent acrylic adhesive disposed on 40# bleached white glassine liner.

Next the laminated web passes through a second die cutting station where a die cutter selectively cuts through portions of the laminate, book and label section 604*b*. The waste laminate with attached waste zones 14 from book 10 and attached label sections pass a guide roller and on to a laminate take up reel. Above and below each label, the cutting dies slice the laminate, books and labels. By simultaneously slicing the laminate, books and labels, the longitudinal edges of the finished labels have a clean uniform edge. The cutting dies do not cut the web at any point.

Figure 7:
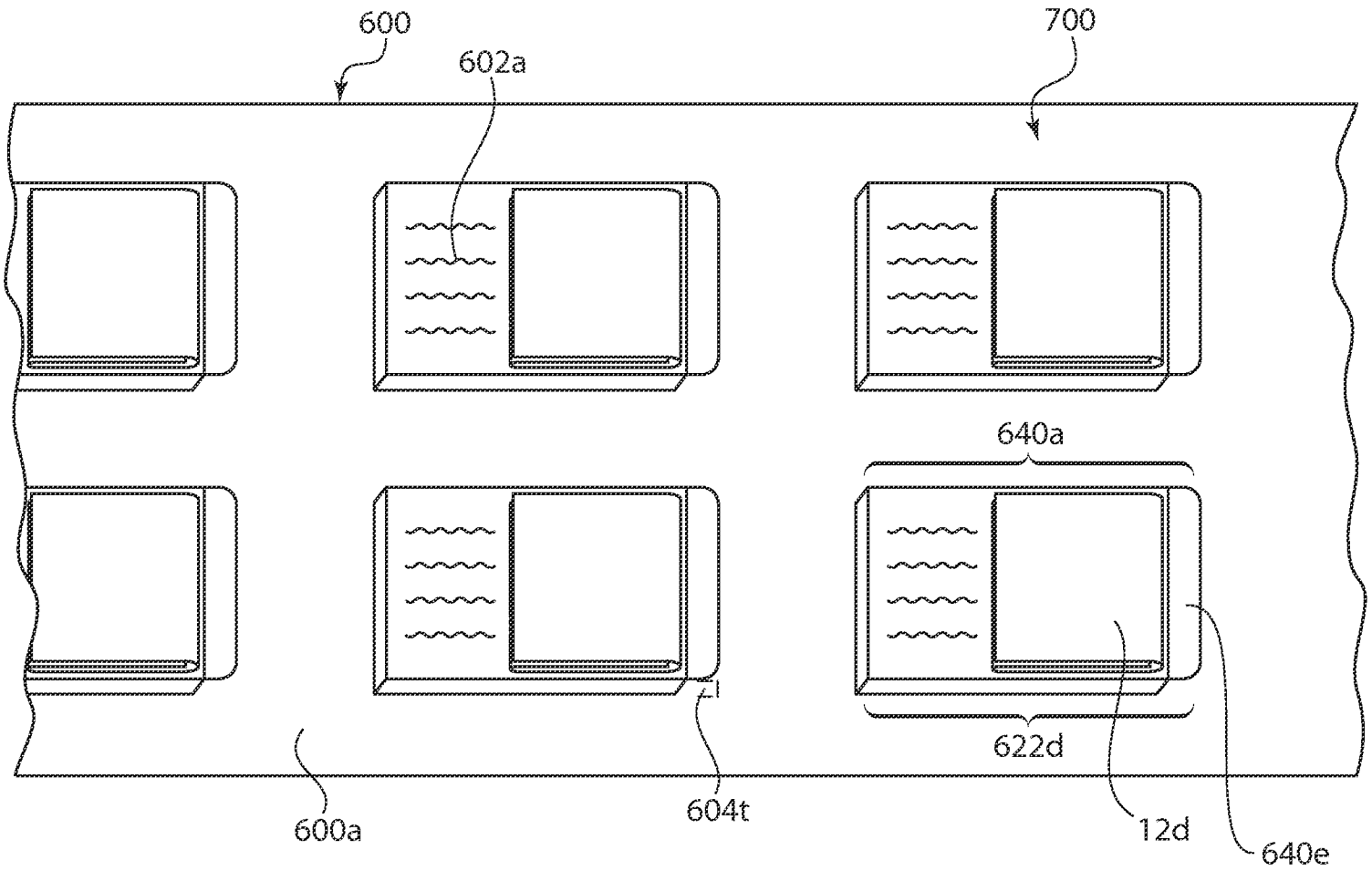
FIG. 7 is a top view of the completed labels.

In FIG. 7 the release liner web 600 with completed labels 700 in a two-up configuration is shown in a top view. While a description will be given of the label in the right bottom corner, such description applies to all labels on the web. The D label 622*d* is shown with an exaggerated thickness to illustrate that the remaining sections of paper 600*b* have now been removed from the release liner 600*a* of web 600. The 12*d* booklet is adhered to the right side of label 622*d*. The remaining laminate 640 overlies labels 622*d* and extends further off the right side thereof to form laminate tab 640*e*. Laminate 640*a* is adhered to the exposed (left) portion of label 622*d* and is adhered to booklet 12*d*. The web may be slit in between the two labels, and each row of labels may be wound onto individual spools, providing several one-up label rolls.

FIGS. 6A and 6B show the right edge of book 10 aligned with the right edge of label section 604*b*. In an alternate embodiment the right edge of book 10 is spaced from the right edge of label section 604*b* to create a label tab. The label tab can be unitary with label section 604*b*, or a perforation can be provided between the label tab and label section 604*b*. The perforations can be formed within the first die cutting station. This label tab would extend underneath laminate tab 640*e*, that is the label tab would reside between laminate tab 640*e* and release liner 600*a*. An example of the label tab 604*t* is shown in dotted line in the bottom, center label of FIG. 7. According to this embodiment, the laminate tab 640*e* would be peeled from and re-adhered to the label tab, rather than the plastic bottle 800 (as shown in FIGS. 8A-C). If the label tab is perforated, it can be removed if the user prefers to have the laminate tab adhere to the container.

The completed labels 700 from FIG. 7 are peeled off the release liner and the label 622*d* is adhered to a container. FIG. 8A shows label 622*d* adhered to a cylindrical plastic bottle. The section of overlaminate where it transitions from label 622*d* to booklet 12*d* forms a hinge 700*a*. The hinge holds booklet 12*d* so that label 622*d* can freely conform to any radius container. In other words, label 622*d* can be adhered to the container without interference from the multiple pages of booklet 12*d*.

The web may wrap around a peel edge to release the completed label. As the label begins to separate from the web, a bottle is introduced. A roller 810 rotates clockwise while pressed against the bottle which rotates counter-clockwise. As the label is progressively adhered the pages within the booklet can shift and slide without effecting the smooth application of the label to the curved surface. Often in prior art booklet labels, the booklet is adhered to the label. This arrangement ties the overlaminate, booklet and label together. When this ensemble has many pages or bends around a small radius, the outer pages need to travel a further distance than the inner pages. Since all components are tied together, the ensemble will crease. According to the invention, the label can adhere to the container while the booklet and laminate are free to independently conform to the containers radius. Thus, the booklet and label are being pressed against the container at the same time, but are free to shift and slide without interference from the other.

After label 622*d* is completed adhered, the roller then arrives at the laminate tab 640*e*. The laminate tab wraps the booklet around the bottle and adheres to the bottle in a location that is totally independent from the label, as shown in FIG. 8B. Accordingly, one label configuration can be used on bottles with different radii. In addition, booklets of different styles, sizes and thicknesses can be used in a standard manufacturing set up. The laminate tab is self adjusting to enclose booklets of any thickness and securely hold them closed until needed. Thus, the laminate tab can adhere to the container closer or farther from the label. If label tab 604*t* is included, as shown in FIG. 8C in dotted line, it will extend beyond the edge of booklet 12*d*. When laminate tab 640*e* is wrapped towards the bottle it will adhere to label tab 640*t*.

The bottle with enclosed booklet as shown in FIG. 8B is ready to be packaged, shipped and sold. When the booklet needs to be accessed, the laminate tab 640*e* is peeled away from the bottle, pivoting at hinge 700*a* to carry the booklet away from the bottle, to a configuration shown in FIG. 8C. If the laminate tab is large or uses very strong adhesive, it may be desirable to reduce the holding strength to facilitate peeling the tab from the bottle. For this purpose, stripes of release material may be printed on the tab. The print area can be adjusted to determine how much adhesive will remain on the tab, thereby controlling the adhesive strength. The booklet can be unfolded at the two fold locations 10*x*(*ii*) and 10*x*(*i*). The user is presented with 6 or more pages of information, with all pages connected together at spine 10*d*. For certain applications, perforations may be provided. For example, a portion of the front page may be ripped off at perforation 50*p*(*i*). An entire page, e.g. the back page, may be ripped off at perforation 50*p*(*ii*).

Figure 8D:
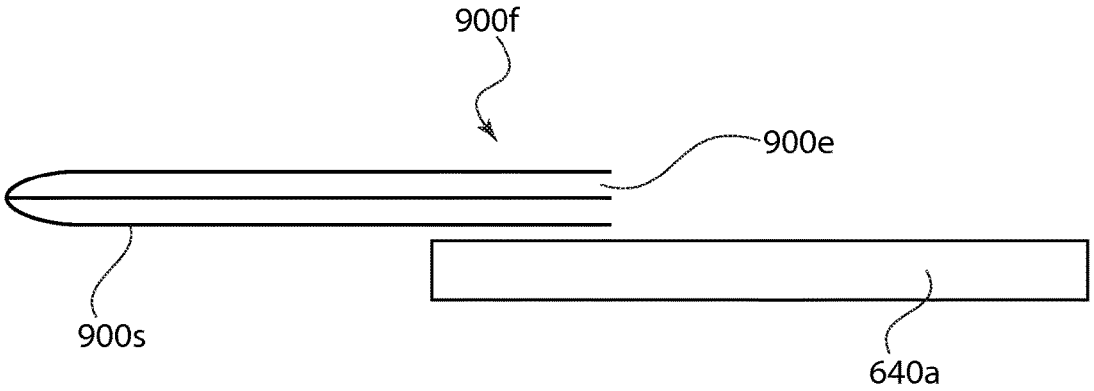
FIG. 8D is a side view of a booklet adhered to the overlaminate in an alternate configuration.
Figure 8E:
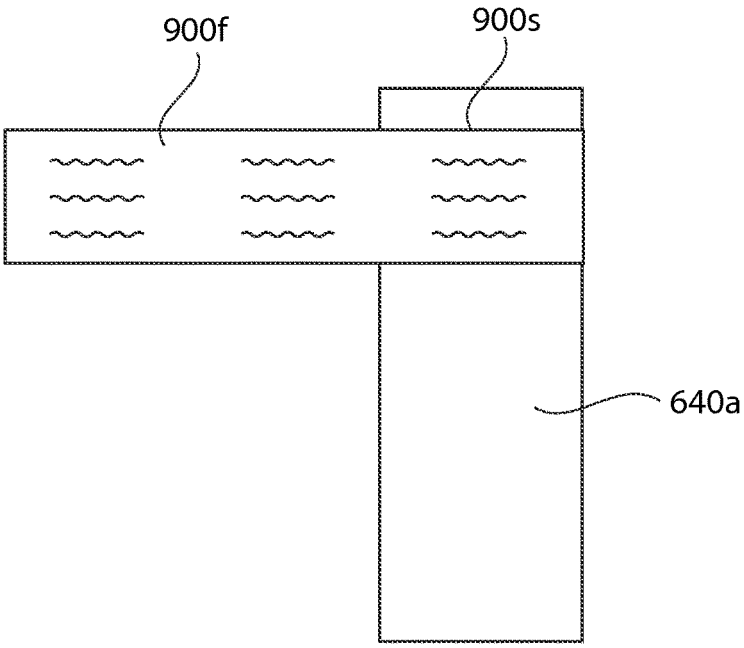
FIG. 8E is a top view of a booklet adhered to the overlaminate in yet another configuration.

FIG. 8C shows the spine section 900*s* adhered to the overlaminate 640*a*, with middle section 900*m* and free edge section 900*f* being unadhered. The booklet could also have its free edge section 900*f* adhered to the overlaminate. For example, the last page of the booklet within free edge section 900*f* could be adhered to the overlaminate as shown in FIG. 8D. In this configuration, the free edges 900*e* would be disposed adjacent the hinge 700*a* of the overlaminate. In the event the label is used on a flat surface, or a surface curving perpendicular to the bottle shown in FIG. 8A-8C, the booklet could be secured to the overlaminate in an alternate orientation. For example, FIG. 8E shows the booklet with its free edge section 900*f* opening in a lateral direction from overlaminate 640*a* (and the substrate/label). As a further embodiment, the free edge section 900*f* could be adhered to overlaminate 640*a* with the spine section 900*s* opening in a lateral direction with respect to the overlaminate (and the substrate/label). For the orientation of FIG. 8A-8D the booklet opens in a longitudinal direction with respect to the overlaminate (and the substrate/label). Other orientations are possible, and would be facilitated if the substrate and overlaminate were provided with angular edges, for example, partial or full hexagonal or octagonal shapes.

The key features of the booklet product according to the invention are a booklet compactly folded, ideally with two or more folds with the free edges tucked inside. The booklet shall remain unconnected to the substrate or label. The overlaminate being adhered to the substrate/label and to the folded booklet. The overlaminate having a hinge portion to pivot the booklet away from the container/substrate/label so that the booklet can be unfolded to allow the pages to be opened.

While various forms of books and booklets have been shown and described, it should be understood that additional configurations may be provided within the scope of the application. For example, books with a greater number of pages may be provided. Books having two or more booklets contained therein may be included. Books with different fold locations and directions may be provided. In addition, several embodiments have been shown and described for a manufacturing process. Additional steps, or steps executed in different order are included within the scope of the invention. For example, adhesive and the release liner can be applied to the web before or after the labels are printed.

Having described preferred embodiments for substrates, booklets, folds, overlaminates and extended content booklet labels (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A label form comprising:

a substrate web extending in a longitudinal direction and having an upper surface devoid of adhesive and a lower surface, wherein the upper surface includes at least a first portion and a second portion;

a multi-up book including two or more booklets and a waste zone disposed in between each adjacent pair of booklets, said multi-up book having a common spine for said two or more booklets and said waste zone and a cover sheet, a back sheet and two or more internal sheets held together at said spine and extending from said spine in the longitudinal direction and including free edges which are spaced from and parallel to said spine; and an overlaminate having a lower surface covered with adhesive to adhere to said multi-up book and said upper surface of the substrate to hingedly connect the multi-up book to the substrate with said common spine oriented across the width of said substrate web in a direction perpendicular to the longitudinal direction.

2. The label form of claim 1, further including a release liner and a layer of adhesive disposed on the lower surface of said substrate web, wherein said lower surface of said substrate web is removably adhered to said release liner.

3. The label form of claim 2, wherein the release liner is a continuous web extending in the longitudinal directions with two or more extended content booklet labels adhered across the width of the web in a direction perpendicular to the longitudinal direction.

4. The label form of claim 3, wherein said waste zone has a width that determines the extended content booklet labels spacing from each other across the width of the web.

5. The label form of claim 3, wherein said multi-up book includes one or more further waste zones at one end of said book in the width direction.

6. The label form of claim 1, wherein said substrate web is larger than said booklet.

7. The label form of claim 6, wherein said substrate web includes indicia printed on said second portion of the upper surface of said substrate, and wherein said overlaminate is translucent to allow viewing of (i) the indicia printed thereunder and (ii) the spine of said booklet.

8. The label form of claim 1, wherein said overlaminate includes a first portion adhered to said folded booklet, a second portion adhered to said substrate, and a hinge portion disposed between said first and second portions.

9. The label form of claim 8, wherein said spine of said booklet is disposed adjacent said hinge portion of said overlaminate.

10. The label form of claim 8, wherein said overlaminate is configured to pivot along its hinge portion between an open position in which said first portion of said overlaminate and said adhered folded booklet is pivoted away from said substrate web; and a closed position in which said folded booklet can conform to the curvature of a cylindrical container independent of the substrate web.

11. The label form of claim 1, wherein said overlaminate includes a tab portion which extends beyond said booklet.

12. The label form of claim 11, wherein said substrate includes a third portion that extends beyond the first portion, and wherein the tab is removably adhered to said third portion of said substrate.

13. The label form of claim 11, wherein said tab portion extends beyond said substrate.

14. The label form of claim 1, wherein said multi-up book is divided into three sections along the longitudinal direction including a spine section, a middle section and a free edge section; said free edge section is first folded to overlie said middle section; said spine section is second folded to overlie said free edge section for form a folded multi-up book; wherein said folds form three sections of different sizes, wherein the middle section is longer than said free edge section and shorter than said spine section.

15. The label form of claim 14, wherein the spine and middle sections form a ramp up on one side of the booklet leading to a central portion of the booklet which includes the spine, free edge and middle sections, and wherein the spine section forms a ramp down on the other side of the booklet leading from the central portion.

16. The label form of claim 15, wherein the ramp up includes two sections, and wherein the central portion includes three sections, and wherein the ramp down includes one section.

17. A label form comprising:

a substrate web extending in a longitudinal direction and having an upper surface devoid of adhesive and a lower surface, wherein the upper surface includes at least a first portion and a second portion;

a multi-up book including two or more booklets and a waste zone disposed in between each adjacent pair of booklets, said multi-up book having a common spine for said two or more booklets and said waste zone and a cover sheet, a back sheet and two or more internal sheets held together at said spine and extending from said spine in the longitudinal direction and including free edges which are spaced from and parallel to said spine; wherein said multi-up book is divided into three sections along the longitudinal direction including a spine section, a middle section and a free edge section; said free edge section is first folded to overlie said middle section; said spine section is second folded to overlie said free edge section to form a folded booklet having said spine section on top, said middle section on the bottom, and said free edge section sandwiched therebetween; wherein the booklet folds form three sections of different sizes, wherein the middle section is longer than said free edge section and shorter than said spine section; wherein the spine and middle sections form a ramp up on one side of the booklet leading to a central portion of the booklet which includes the spine, free edge and middle sections, and wherein the spine section forms a ramp down on the other side of the booklet leading from the central portion; wherein the ramp up includes two sections, and wherein the central portion includes three sections, and wherein the ramp down includes one section; wherein said middle section is placed directly on a first portion of said upper surface of said substrate; and an overlaminate having a lower surface covered with adhesive to adhere said folded book to said second portion of the upper surface of the substrate to hingedly connect the multi-up book to the substrate with said common spine oriented across the width of said substrate web in a direction perpendicular to the longitudinal direction.

* * * * *